US012642367B2

(12) United States Patent
Chauhan et al.

(10) Patent No.: US 12,642,367 B2
(45) Date of Patent: Jun. 2, 2026

(54) REFRIGERATED MERCHANDISER WITH TUNABLE AIRFLOW DISCHARGE

(71) Applicant: Hussmann Corporation, Bridgeton, MO (US)

(72) Inventors: Monish B. Chauhan, Ontario, CA (US); Michael A. Gillett, Perris, CA (US); Sandeep Palaksha, Bangalore (IN)

(73) Assignee: Hussmann Corporation, Bridgeton, MO (US)

( * ) Notice: Subject to any disclaimer, the term of this patent is extended or adjusted under 35 U.S.C. 154(b) by 132 days.

(21) Appl. No.: 18/575,247

(22) PCT Filed: Jul. 13, 2022

(86) PCT No.: PCT/US2022/036895

§ 371 (c)(1),
(2) Date: Dec. 28, 2023

(87) PCT Pub. No.: WO2023/287842

PCT Pub. Date: Jan. 19, 2023

(65) Prior Publication Data

US 2024/0324794 A1 Oct. 3, 2024

Related U.S. Application Data

(60) Provisional application No. 63/221,257, filed on Jul. 13, 2021.

(51) Int. Cl.
*A47F 3/04* (2006.01)

(52) U.S. Cl.
CPC ..... *A47F 3/0413* (2013.01); *A47F 3/0434* (2013.01)

(58) Field of Classification Search
CPC .. A47F 3/04–0413; A47F 3/0443–0456; A47F 3/0478–0491; F25D 17/045;
(Continued)

(56) References Cited

U.S. PATENT DOCUMENTS 2,625,873 A 1/1953 Kennedy
2,863,302 A 12/1958 Morris
(Continued)

FOREIGN PATENT DOCUMENTS

CN 209558618 U 10/2019
DE 2909860 A1 9/1980
(Continued)

OTHER PUBLICATIONS

International Search Report and Written Opinion for Application No. PCT/US2022/036895 dated Jan. 4, 2023 (3 pages).

*Primary Examiner* — Christopher R Zerphey
(74) *Attorney, Agent, or Firm* — Michael Best & Friedrich LLP

(57) ABSTRACT

A merchandiser including a case that defines a shelf configuration and that has a base and a rear wall cooperating to at least partially define a product display area. The merchandiser also includes an air passageway that extends through base and at least partially along the rear wall, and a fan that is in communication with the air passageway and that generates an airflow through the air passageway. The merchandiser further includes a discharge grill and a vane control. The discharge grill is positioned in the air passageway and has one or more vanes with a discharge angle to direct the airflow through the case. The vane control is coupled to the one or more vanes and has a mechanism that adjusts the discharge angle of the one or more vanes to control the airflow through the merchandiser based at least in part on the shelf configuration.

20 Claims, 9 Drawing Sheets

(58) Field of Classification Search
CPC ..... F25D 2317/063; F24F 13/10; F24F 13/14; F24F 2013/1446
See application file for complete search history.

(56) References Cited

U.S. PATENT DOCUMENTS

| | | | | |
|---|---|---|---|---|
| 3,608,468 | A | 9/1971 | McClurkin | |
| 5,722,252 | A | 3/1998 | Kang et al. | |
| 5,737,935 | A * | 4/1998 | Heo | F24F 13/075 62/186 |
| 5,918,479 | A * | 7/1999 | Ji | F25D 17/045 62/187 |
| 5,970,736 | A * | 10/1999 | Gong | F25D 17/045 62/419 |
| 6,131,403 | A * | 10/2000 | Ji | F25D 17/045 454/153 |
| 6,519,962 | B1 | 2/2003 | Schuetter | |
| 6,722,149 | B1 * | 4/2004 | Saroka | A47F 3/0447 454/193 |
| 7,497,770 | B2 | 3/2009 | Grassmuck et al. | |
| 8,939,824 | B1 * | 1/2015 | Bash | F25D 17/045 62/178 |
| 10,634,412 | B2 | 4/2020 | Boehringer et al. | |
| 2005/0138943 | A1 * | 6/2005 | Alahyari | A47F 3/0447 62/256 |
| 2009/0013707 | A1 | 1/2009 | Spillner | |
| 2009/0223237 | A1 | 9/2009 | Grassmuck et al. | |
| 2016/0282008 | A1 | 9/2016 | Nemoto | |
| 2017/0231403 | A1 | 8/2017 | Eget et al. | |

FOREIGN PATENT DOCUMENTS

| | | | |
|---|---|---|---|
| GB | 1027506 | A | 4/1966 |
| GB | 1291950 | A | 10/1972 |
| GB | 2522666 | A | 8/2015 |
| KR | 19980066040 | U | 12/1998 |
| KR | 19990017859 | A | 3/1999 |
| KR | 19990032436 | A | 5/1999 |
| KR | 100176666 | B1 | 10/1999 |
| KR | 200491606 | Y1 | 5/2020 |
| WO | 2010068367 | A1 | 6/2010 |
| WO | 2019193136 | A1 | 10/2019 |

* cited by examiner

REFRIGERATED MERCHANDISER WITH TUNABLE AIRFLOW DISCHARGE

BACKGROUND

The present application relates to a refrigerated merchandiser and, more particularly, to an adjustable airflow discharge to condition a product display area of the refrigerated merchandiser.

In conventional practice, supermarkets and convenience stores are equipped with refrigerated merchandisers, some of which may include doors that enclose a product display area that supports fresh or frozen product. Typically, refrigerated air is provided to the product display area via heat exchange in an evaporator and one or more air passageways in the merchandiser. In some existing merchandisers (e.g., service cases with rear doors and multiple shelves) have fixed air discharge grills that are located at the rear of the case and in a low position so as not to compromise product visibility and rear door usability. The location of this discharge grill creates a significant air feeding and control problem because the airflow must be distributed to condition the lower deck and the shelves. Standard discharge grills (e.g., moiré style) do not adequately address the airflow issues because they create concentrated air streams that cannot evenly distribute the discharge air over the shelves. As a result, product temperatures on the middle shelves suffer. Also, reducing mass flow with a moiré grill pattern demonstrates little to no improvement in airflow over the shelves. The very top shelf and the deck level are adequately conditioned, but the bottom and middle shelves have stagnant air above the product. And existing grills are inadequate for optimizing the airflow for different case configurations.

In some existing merchandisers, a deflector can be attached to the rear of the shelf to direct a portion of the airflow over and/or around product on the shelf. Deflectors improve mass flow distribution, but they create additional issues. For example, deflectors tend to impede the service ergonomics of the case by forming obstructions in areas that service personnel find inconvenient when retrieving merchandise. Each deflector also needs to be balanced relative to how much air is directed away from the primary airflow and relative to other deflectors to avoid deteriorating performance in other zones. When a shelf is added, removed, or repositioned, the deflectors need to be rebalanced.

SUMMARY

According to an exemplary embodiment, the invention includes a merchandiser including a case that defines a shelf configuration and that has a base and a rear wall cooperating to at least partially define a product display area. The merchandiser also includes an air passageway that extends through base and at least partially along the rear wall, and a fan that is in communication with the air passageway and that generates an airflow through the air passageway. The merchandiser further includes a discharge grill and a vane control. The discharge grill is positioned in the air passageway and has one or more vanes with a discharge angle to direct the airflow through the case. The vane control is coupled to the one or more vanes and has a mechanism that adjusts the discharge angle of the one or more vanes to control the airflow through the merchandiser based at least in part on the shelf configuration.

According to another exemplary embodiment, the merchandiser includes a case that has a first case configuration and that defines a product display area, and an air passageway that extends through the case. The merchandiser also includes a fan that is in communication with the air passageway and that is configured to generate an airflow through the air passageway. The merchandiser further includes a discharge grill that is positioned in the air passageway and that has one or more vanes with a first discharge angle to direct the airflow through the case. A vane control is coupled to the one or more vanes and has a mechanism that is configured to adjust the discharge angle of the one or more vanes to control the airflow through the merchandiser.

BRIEF DESCRIPTION OF THE DRAWINGS

The aspects and features of various exemplary embodiments will be more apparent from the description of those exemplary embodiments taken with reference to the accompanying drawings.

DETAILED DESCRIPTION

Figure 1:
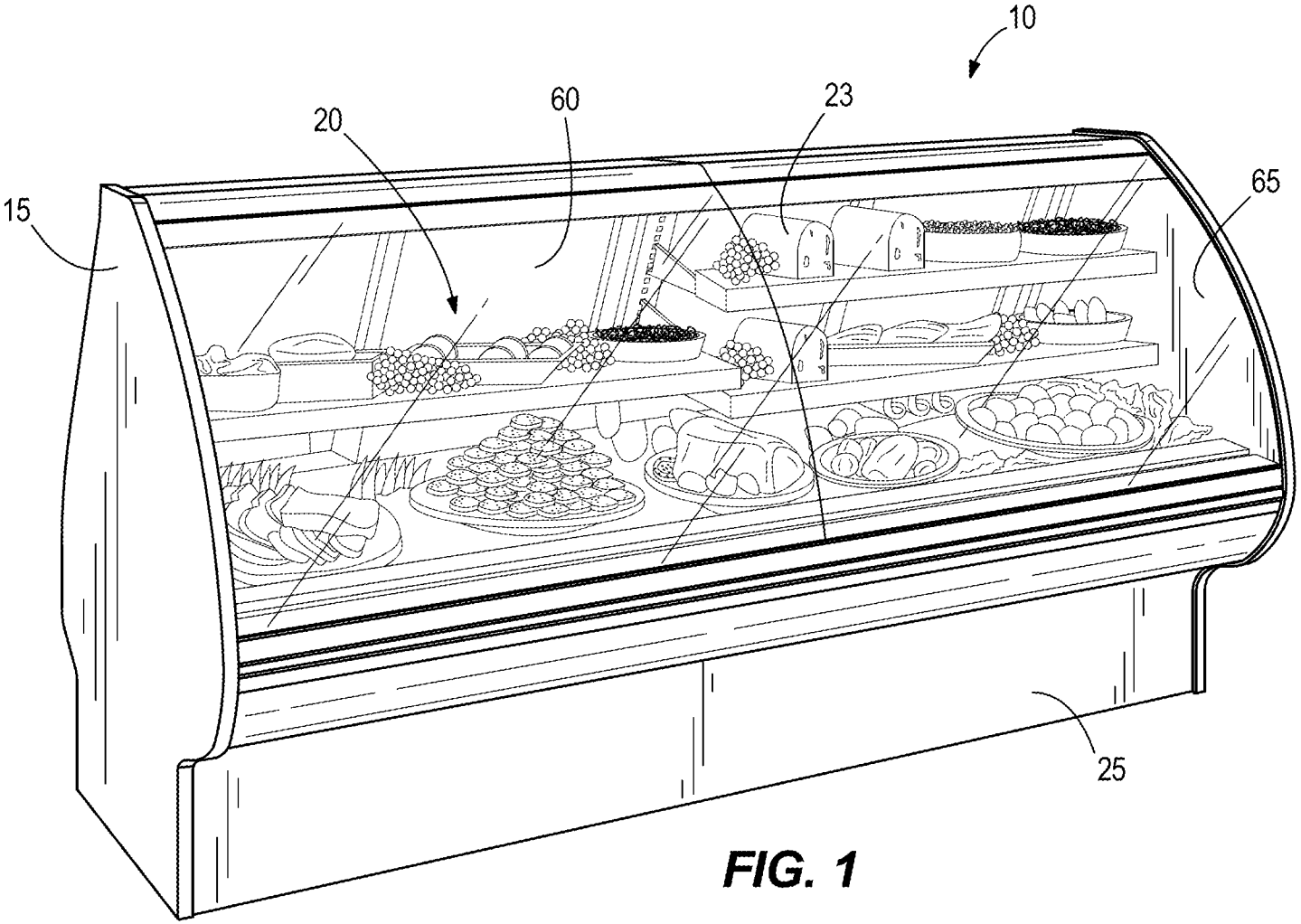
FIG. 1 is a perspective view of an exemplary refrigerated merchandiser.
Figure 2:
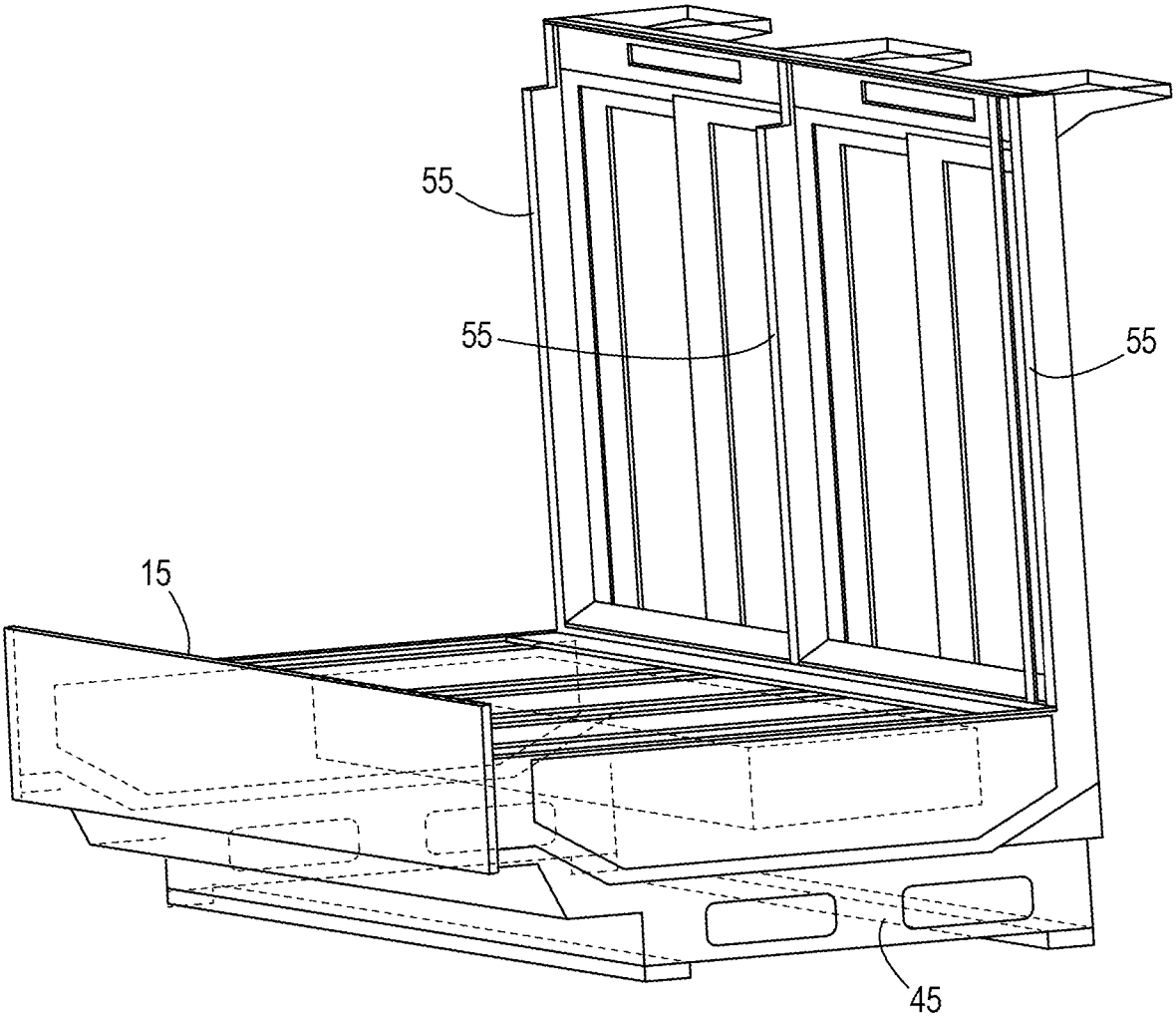
FIG. 2 is a perspective view of a portion of the merchandiser of FIG. 1 illustrating rear access openings and an adjustable discharge grill embodying the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

FIGS. 1-4 illustrate an exemplary embodiment of a merchandiser 10 (e.g., a low temperature merchandise 10, or, or a medium temperature merchandiser 10) that may be located in a supermarket, a convenience store, or other settings for presenting fresh food, beverages, and other products. The illustrated merchandiser 10 is a horizontal merchandiser (e.g., a meat, fish, bakery, or deli-type merchandiser) and includes a case 15 that defines a product display area 20 in which product can be supported. The merchandiser 10 can include one or more interconnected case 15 sections that may have respective refrigeration components (e.g., expansion valve, etc.) of a refrigeration system, or that may share one or more refrigeration components of the refrigeration system. The case 15 has a base 45 and a top wall 50 or canopy 50 that is attached to the base 45 and that is cantilevered over the product display area 20 via uprights. The uprights 55 support a rear wall 40. As shown, the refrigeration system includes a heat exchanger 25 disposed in an air passageway 30 that extends through the base 45 and along the rear wall 40, and a fan 35 that is in communication with the air passageway 30 (e.g., in the air passageway 30) to generate an airflow that can be conditioned by the heat exchanger 25. The refrigeration system can take any form of a system that conditions an airflow and will not be described in detail.

Figure 3:
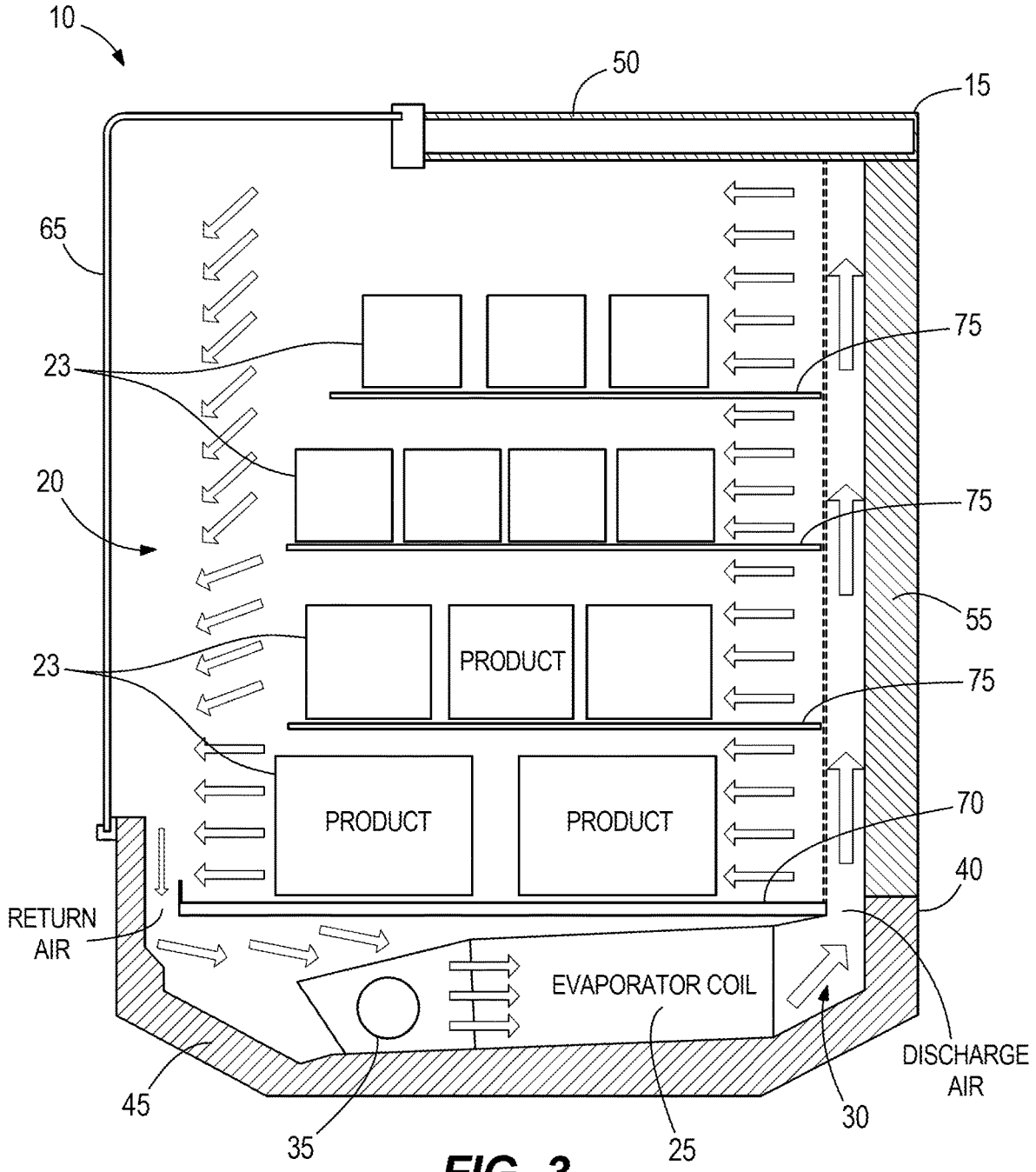
FIG. 3 is a schematic side view of the merchandiser of FIG. 1 illustrating shelves and desired airflow behavior through the merchandiser.
Figure 4:
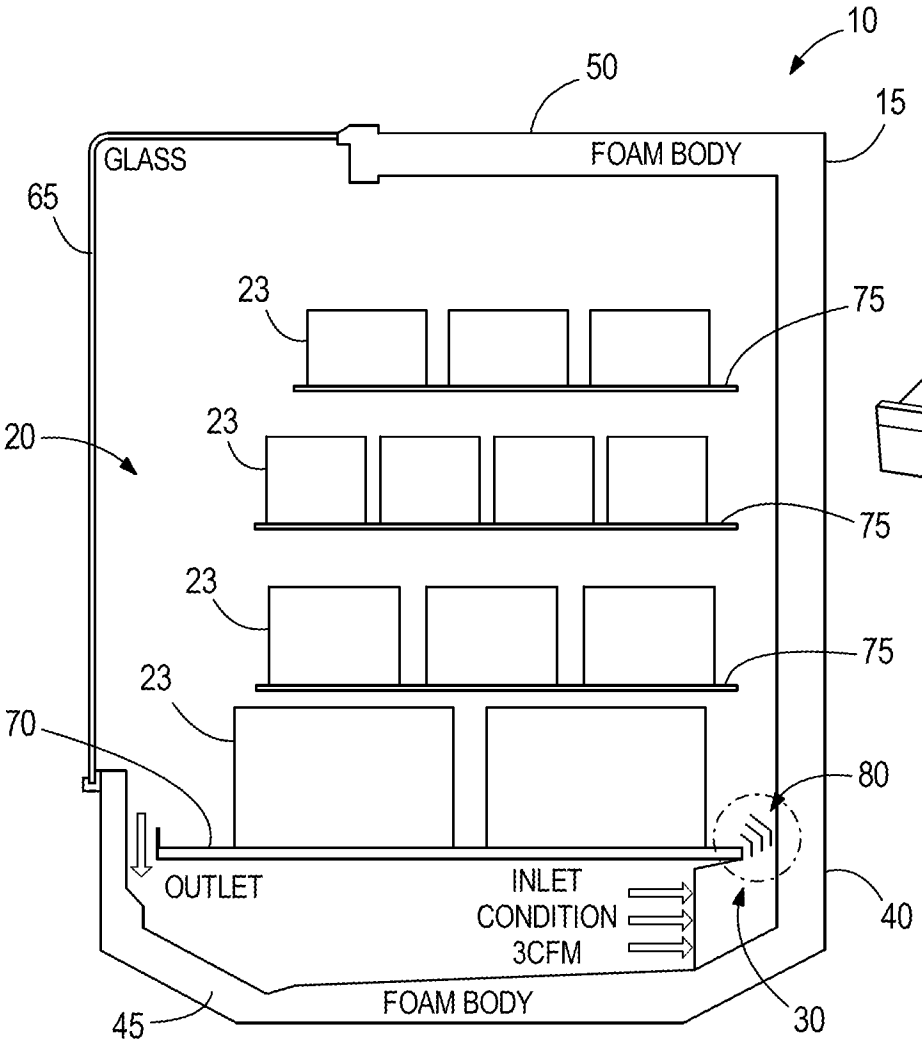
FIG. 4 is another schematic side view of the merchandiser of FIG. 1 illustrating the shelves and the discharge grill.

One or more first glass panels 60 are coupled to a rear of the case 15 between the uprights 55 to enclose the rear side of the merchandiser 10. The first glass panels 60 can be fixed to the uprights 55, or the glass panels 60 may move relative to the uprights 55 to selectively provide access to the product display area 20 from the rear of the merchandiser 10. As shown in FIGS. 1, 3, and 4, the merchandiser 10 also includes one or more second glass panels 65 that enclose the front side of the merchandiser 10. The second glass panel(s) 65 are optional depending on the type of the merchandiser 10. Also, the second glass panel(s) 65 can be fixed in place (i.e. not movable), or the second glass panel(s) 65 may move (e.g., as part of one or more doors) to selectively provide access to the product display area 20 from the front of the case 15.

With reference to FIGS. 3 and 4, the merchandiser 10 includes a deck plate 70 that is coupled to the top of the base, and three shelves 75 positioned above the deck plate 70. As will be appreciated by one of ordinary skill in the art, the shelves 75 are spaced from each other to provide room for supporting product and for airflow along the shelves 75 (e.g., under and/or over the respective shelves 75). The illustrated merchandiser 10 includes a 'triple-shelf' configuration above the deck plate 70, although the merchandiser 10 may have other configurations (e.g., a 'no-shelf' configuration (i.e. the merchandiser 10 only has the deck plate 70), a 'single-shelf' configuration, a 'double-shelf' configuration, or any other configuration (e.g., four or more shelves 75). While the invention is described in detail with regard to a triple-shelf configuration, it will be appreciated that the invention is applicable to other shelf configurations. In general, the term 'shelf configuration' includes or is defined by the quantity of the shelves 75 and the location of the shelves 75 in the case 15, although the term may be defined by only the quantity of the shelves 75.

Figure 5:
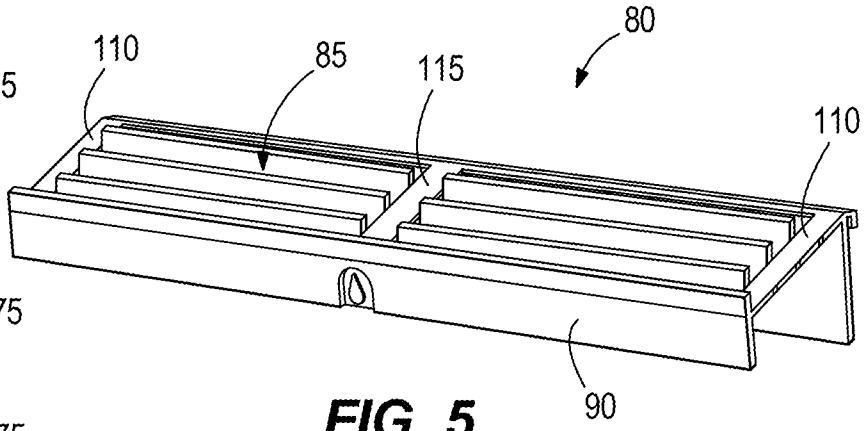
FIG. 5 is a perspective view of the discharge grill.
Figure 6:
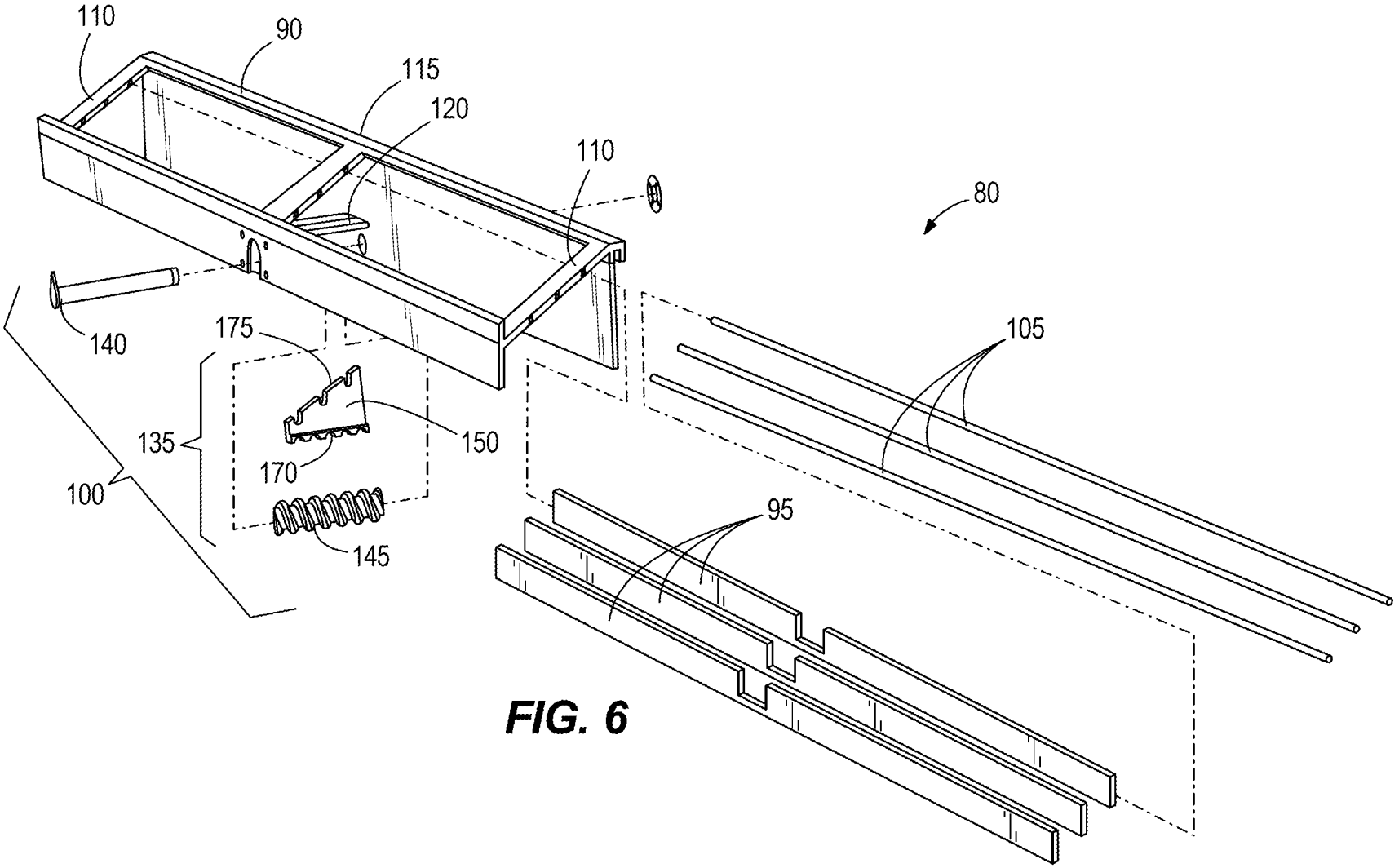
FIG. 6 is an exploded perspective view of the discharge grill of FIG. 5, illustrating a grill frame, vanes, rods, and a vane actuator.

FIGS. 4-6 illustrate that the merchandiser 10 also includes a discharge grill assembly 80 that is at least partially positioned in the air passageway downstream of the heat exchanger 25 at a location that is adjacent the deck plate 70 (e.g., below the shelves 75). The discharge grill assembly 80 includes a discharge grill 85 that has a grill body 90 and vanes 95 that are supported by the grill body 90, and a vane control 100 that is supported by the grill body 90 and that is coupled to the vanes 95. It will be appreciated that the discharge grill 85 may include one vane or more than one vane (e.g., three vanes 95 as shown in the exemplary embodiment).

Figure 7:
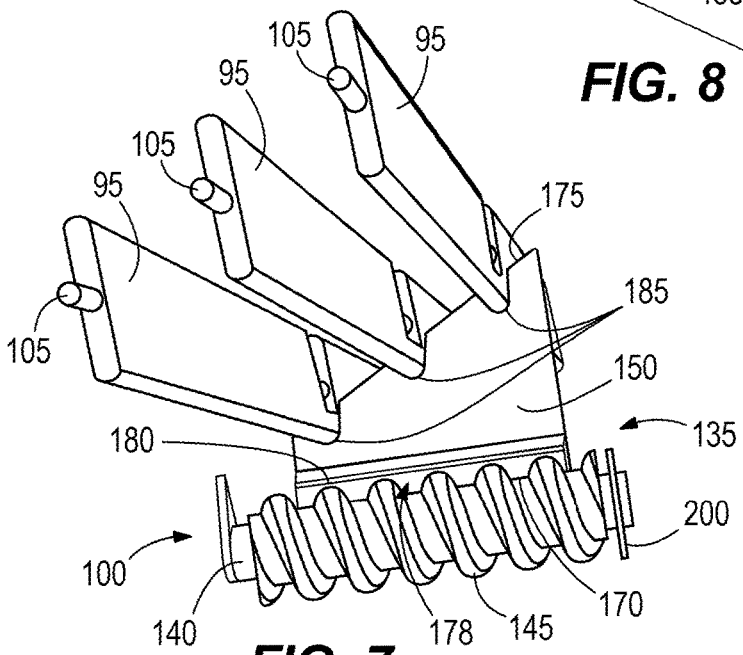
FIG. 7 is a perspective view of the vane actuator and the vanes coupled to the vane actuator by a pinion block.
Figure 9A:
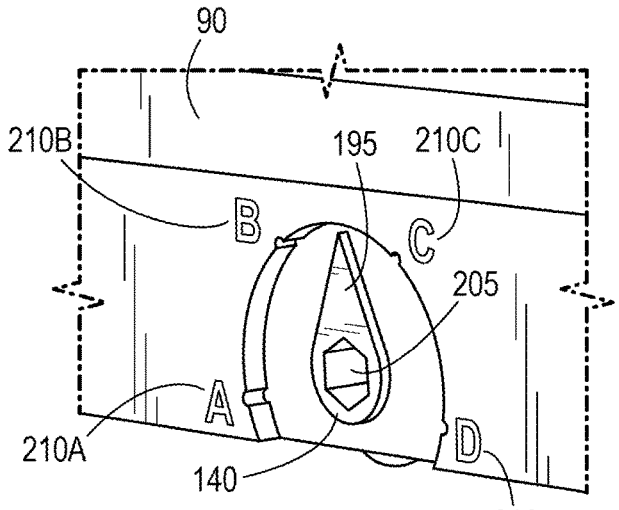
FIG. 9A is a perspective view of a portion of the vane actuator including a dial.
Figure 9B:
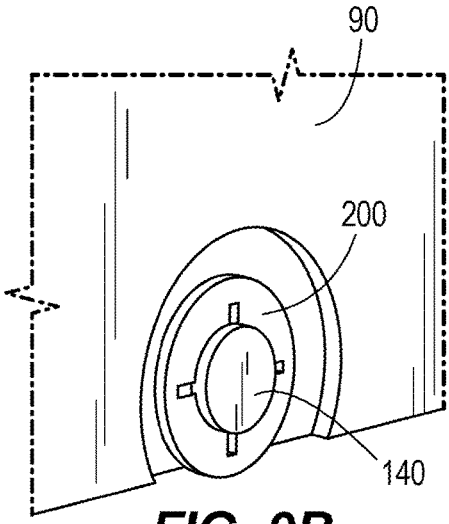
FIG. 9B is a perspective view of the axle lock coupled to the axle.

The grill body 90 is designed to house and support components of the discharge grill assembly 80. With reference to FIGS. 6 and 7, the vanes 95 are movably supported on the grill body 90 by support rods 105 (e.g., cylindrical in cross-section) that extend through the vanes 95 and that are coupled to support webs 110. As shown, the grill body 90 includes lateral support webs 110 and a central support web 115, and the vanes 95 include a notch or center relief cutout to accommodate the central support web 115. Clips or other devices may be used (e.g., on the lateral extents of the support rods 105, on the central support web 115, etc.) to hold the rods 105 in place on the grill body 90. The grill body 90 also includes a vane control support 120 that extends from a front of the grill body 90 to the rear of the grill body 90 (e.g., below the central support web 115). The vane control support 120 has spaced apart brackets that guide movement of the vane control 100 as explained in detail below.

Figure 8:
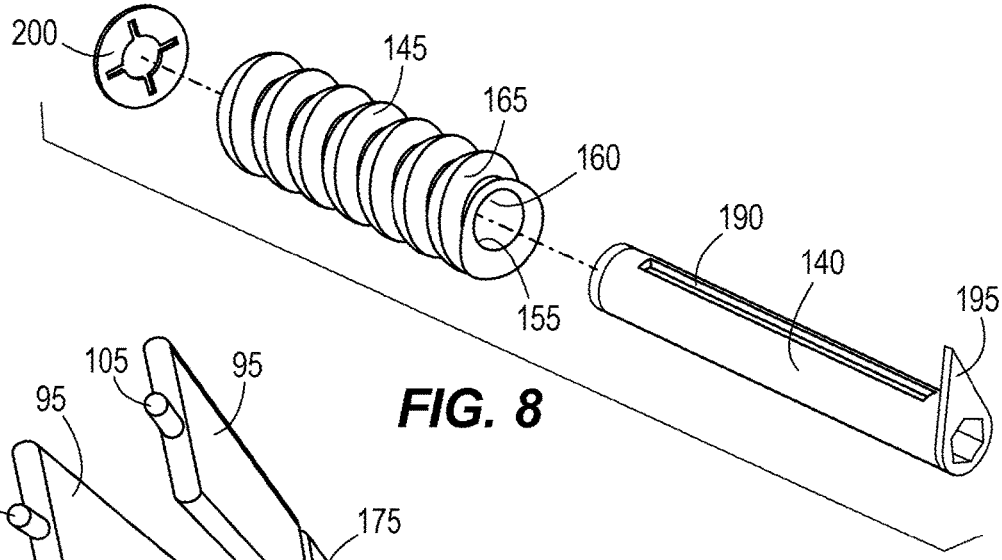
FIG. 8 is an exploded perspective view of the vane actuator, including an axle, a gear, and a gear axle lock.

The vane control 100 is coupled to the vanes 95 to selectively adjust or tune the angular position of the vanes 95 (e.g., selectively change the discharge angle of the vanes 95 relative to a horizontal plane 130) to vary how the airflow is directed generally upward along the rear wall 40 and generally horizontal along the shelves 75 (if any are present) based on the configuration of the case 15. With reference to FIGS. 6-8, the vane control 100 includes a vane adjustment mechanism 135 and an axle 140 that supports the vane adjustment mechanism on the grill body 90. As illustrated, and only as an example, the vane adjustment mechanism 135 has an actuator 145 (e.g., shown as a worm gear) and a vane or pinion block 150 that is movably supported by the actuator 145.

The actuator 145 has a central cavity 155 or hole that defines a keyway 160, and a helical extrusion 165 that extends circumferentially and longitudinally along an exterior surface of the actuator 145. The pitch of the helical extrusion 165 may be pre-calibrated to facilitate desired movement of the vane block 150. Pre-calibration provides an effective range and ease of adjustment of the vane block 150 and, as a result, the vane(s) 95. In some embodiments, the actuator 145 may take the form of circular gears with a reduction box, or another mechanism to facilitate translational movement based on rotational movement.

The vane block 150 has a lower side 170 and an upper, sloped face 175, and lateral extrusions or shoulders 180 that are disposed between the lower side and the upper face 175. The lower side 170 has a toothed pattern 178 that conforms to and is engaged with the helical extrusion 165 to facilitate translational movement of the vane block 150 (i.e. movement forward or backward between the forward and rearward sides of the grill body 90) in response to rotation of the actuator 145. The upper face 175 has pockets or recesses 185 that capture and engage the bottom side of the vanes 95. The quantity of pockets 185 may correspond to the quantity of vanes 95 in the assembly, or there may be more pockets 185 than vanes 95. The lateral shoulders 180 contact an underside of the vane control support 120 on the grill body 90 to stabilize the vane block 150 relative to the grill body 90 (i.e. to prevent rotation of the vane block 150) while permitting translational movement of the vane block 150 relative to the grill body 90 when the vane block 150 is assembled on or coupled to the actuator 145.

With reference to FIGS. 7-9B, the axle 140 is partially disposed in the actuator 145 within the cavity and rotatably attaches the actuator 145 to the grill body 90 via a key 190 that is disposed on an outer surface of the axle 140. The key 190 may be formed monolithically with the axle 140, or otherwise secured to the axle 140. The axle 140 has a vane position indicator 195 on a first end, and the axle 140 is secured to the grill body 90 on a second end that is opposite the first end by an axle lock 200 (e.g., a lock washer). As shown in FIG. 9A, the vane position indicator 195 is recessed in the grill body 90.

The axle 190 also has an adjustment key 205 (e.g., a hex cutout engageable by a hex tool) to facilitate adjustment or tuning of the angular orientation of the vane(s) 95. The illustrated axle 140 is rotatable to different preset positions 210A-D to facilitate angular adjustment of the vanes 95 to preset angles relative to the horizontal plane 130. Each preset position is labeled on the grill body 90 (shown as position "A", position "B", position "C", position "D", respectively) for ease of identification and selection via the vane position indicator 195 and the adjustment key 205. The illustrated axle 140 is movable to each of the preset positions 210A-D, although the axle 140 may be continuously movable between the preset positions 210A-D to facilitate minute adjustment of the angular position of the vane(s) 95. Also, while the invention is described and illustrated with regard to four preset positions for the axle 140 (corresponding to four angular positions of the vanes 95), it will be appreciated that the invention may include fewer or more than four preset positions for the axle 140.

The vane control 100 facilitates adjustment of the angular orientation of the vanes 95 to direct airflow through the merchandiser 10 to condition the product in the case 15 based on the way that product 23 is supported in the merchandiser 10. The angular orientation or discharge angle of the vanes 95 is determined based on a configuration of the case. The case configuration may encompass the quantity of shelves 75, if any are provided, the location(s) of the shelves relative to the discharge grill assembly 80, and a configuration of product that is supported in the case 15. In some constructions, the case configuration may take into account only the quantity of the shelves 75 and a location of the shelves 75 relative to the discharge grill assembly 80 (e.g., without regard to product configuration in the case 15).

Figure 10A:
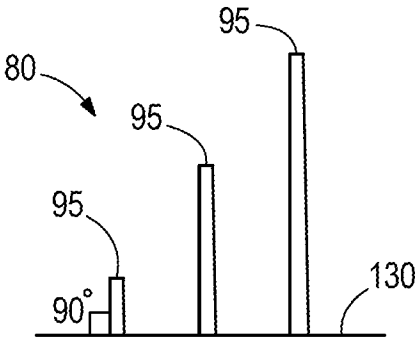
FIGS. 10A-F are schematic end views of the vanes of FIG. 6 in different angular orientations relative to a horizontal plane.
Figure 10B:
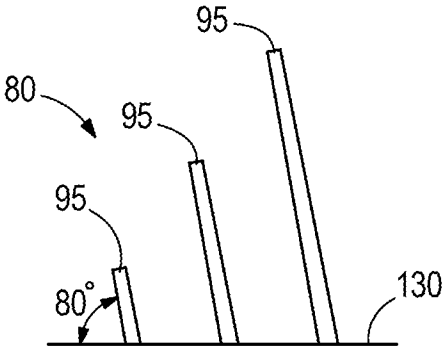
Figure 10C:
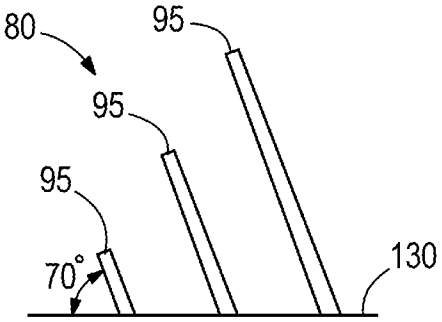
Figure 10D:
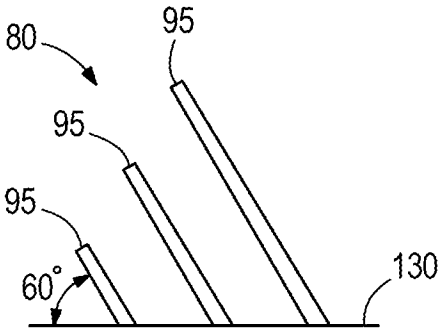
Figure 10E:
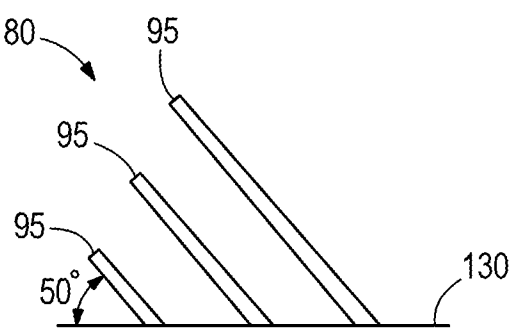
Figure 10F:
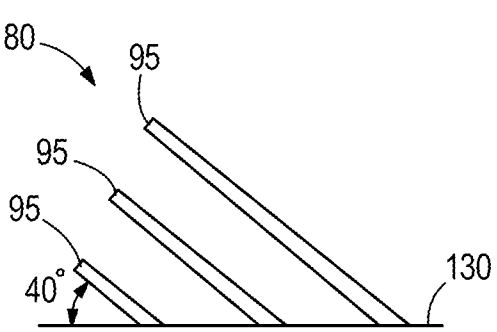
Figure 11A:
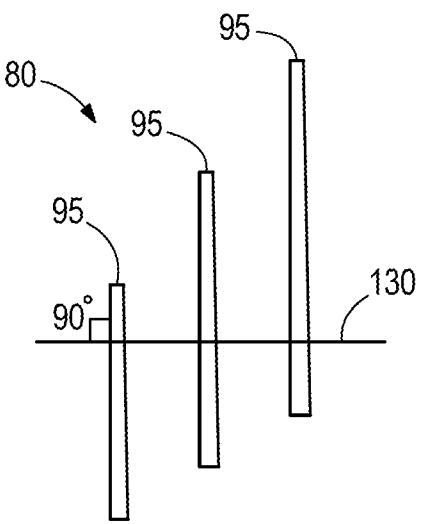
FIGS. 11A-11F are schematic end views of exemplary vanes in different angular orientations relative to a horizontal plane.
Figure 11B:
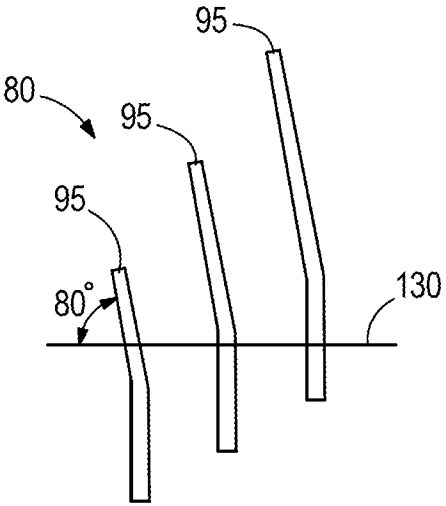
Figure 11C:
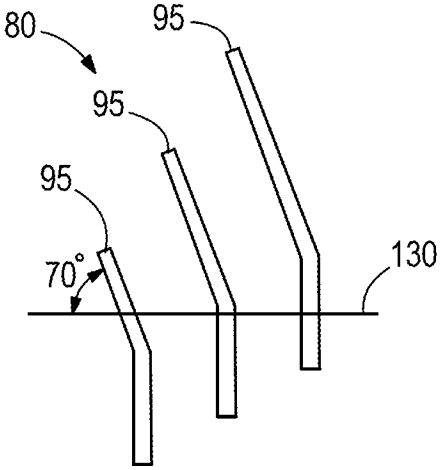
Figure 11D:
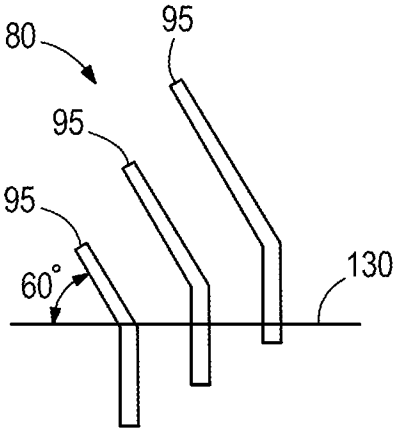
Figure 11E:
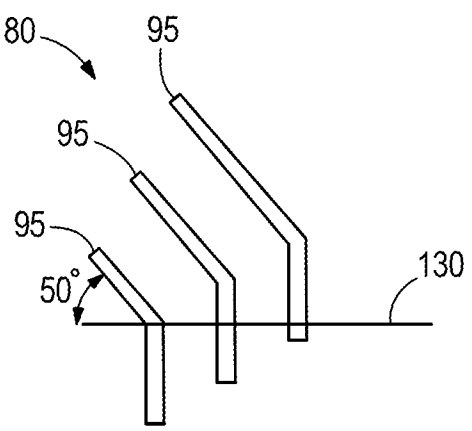
Figure 11F:
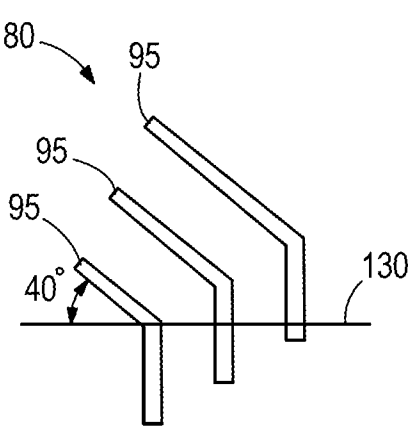
Figures 12A, 12B, 12C, 12D, 12E, 12F:
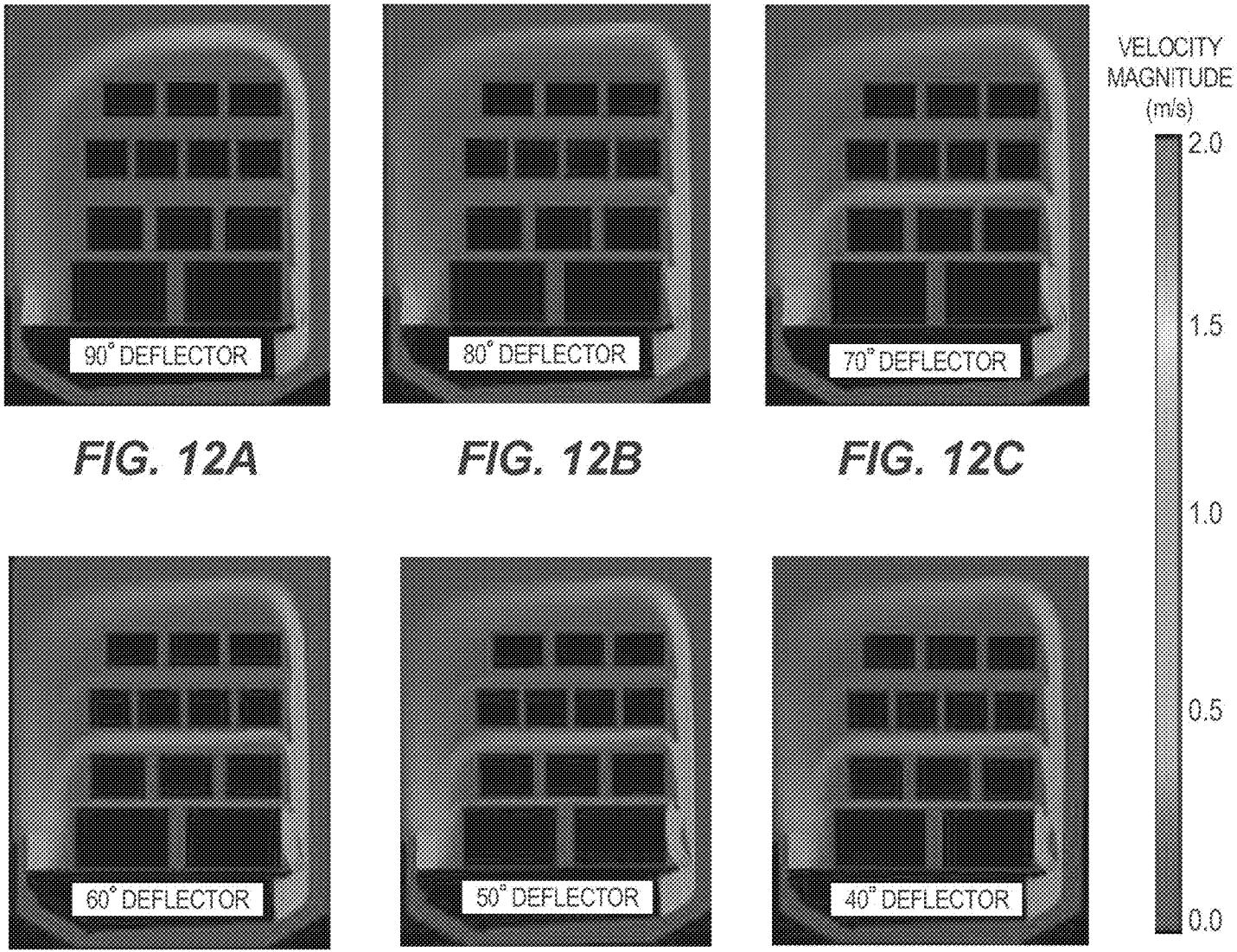
FIGS. 12A-F illustrate simulations of airflow according to different angular orientations of the vanes consistent with the orientations in FIGS. 10A-F and 11A-F.

For example, and with reference to FIG. 10A, which shows that the vanes 95 are oriented at a 90-degree angle relative to the horizontal plane 130 (e.g., position 210A), the airflow is directed generally vertically along the rear wall 40. This airflow pattern may correspond to the merchandiser 10 with the no-shelf configuration. FIG. 10B illustrates the vanes 95 oriented at an 80-degree angle relative to the horizontal plane 130 (e.g., position 210B). In this angular orientation, the airflow is still directed generally vertically along the rear wall 40, but also somewhat outward into the product display area 20. This airflow pattern may correspond to the merchandiser 10 with the single-shelf configuration, which facilitates airflow across the deck plate 70 and along (e.g., under and over) the shelf 75. FIG. 10C illustrates the vanes 95 oriented at a 70-degree angle relative to the horizontal plane 130 (e.g., position 210C). In this angular orientation, the airflow is directed at more of an angle to facilitate an airflow pattern that may correspond to the merchandiser 10 with the double-shelf 75 configuration, which facilitates airflow across the deck plate 70 and along (e.g., under and over) the two shelves 75. FIG. 10D illustrates the vanes 95 oriented at a 60-degree angle relative to the horizontal plane 130 (e.g., position 210D). In this angular orientation, the airflow is directed at even more of an angle than position 210C to facilitate a more horizontal airflow pattern that may correspond to the merchandiser 10 with the triple-shelf configuration, which facilitates airflow across the deck plate 70 and along (e.g., under and over) the three shelves 75. Additional angular positions of the vanes 95 are also possible, as shown in FIG. 10E, which illustrates the vanes 95 at a 50-degree angular orientation, and FIG. 10F, which illustrates the vanes 95 at a 40-degree angular orientation.

In operation, the axle 140 is turned to rotate the actuator 145, which translates the vane block 150 forward and backward along the actuator 145. Movement of the vane block 150 pulls the lower end of the vane(s) 95 in the same direction, which changes the discharge angle of the vanes 95. The angular position(s) of the vanes 95 are determined based on desired airflow characteristics within the merchandiser 10. In some constructions, one or more of the vanes 95 may be adjustable or tunable relative to the remaining vane(s) 95 to generate an airflow that is tailored to a specific setup of the shelves 75 and the deck plate 70 within the merchandiser 10, or to accommodate other factors that impact airflow and adequate conditioning of the product display area 20. In these constructions, one or more vanes 95 has a first discharge angle, and at least one other vane 95 has a second discharge angle. The vane control 100 may be designed so that the vanes 95 are simultaneously adjustable to the first discharge angle and the second discharge angle.

FIGS. 11A-11F illustrate another embodiment of the discharge grill assembly 80 in which an upper portion of the vanes 95 is adjustable relative to a lower portion of the vanes 95. The angular orientation of the vanes 95 is selected based on the desired airflow characteristics within the case 15 in a manner that is consistent with what is described relative to FIGS. 10A-10F. The vane control 100 may be used to facilitate adjustment of the angular orientation of the vanes 95 illustrated in FIGS. 11A-F.

FIGS. 12A-F illustrate airflow through an exemplary merchandiser 10 including the deck plate 70 and three shelves 75, and with the vanes 95 in different angular orientations (consistent with what is illustrated in FIGS. 10A-F and 11A-F. These Figures illustrate a comparative plot that illustrates the effect of the discharge angle on the velocity of air over each product level (i.e. the deck plate 70 and the shelves 75). The illustrated air velocity correlates to convective heat transfer, which is the primary method of cooling product in many merchandisers 10. In this example with three shelves 75, positions A and B (corresponding to the vanes 95 at 90 degrees and 80 degrees, respectively) do not provide adequate airflow for product on the lower two shelves 75 or for the product on the deck plate 70. As the vanes 95 are adjusted to 70 degrees (or lower, relative to the horizontal plane 130), the airflow along the deck plate 70) and the shelves 95 begins to even out and provide adequate cooling at all levels within the merchandiser 10. FIGS. 12A-F illustrate just one example of how the vanes 95 can be adjusted based on the configuration of the shelves 75 (if any) in the merchandiser 10. It should be appreciated that different angular ranges may be appropriate depending on the shelf configuration, as well as on product size and other factors affecting airflow within the merchandiser 10.

With reference to FIGS. 10A-F and 11A-F, the vanes 95 are elongated relative to conventional moiré grill patterns, which facilitates better directional control of airflow in the merchandiser 10 relative to these existing grills. Although these Figures illustrate vanes 95 of different heights (vertically in FIGS. 10A-11F), the vanes 95 may have the same height. The vanes 95 may taper smaller from bottom to top, or the vanes 95 may be substantially the same (or the same) thickness. As best shown in FIGS. 6, 7, and 11A-11F, the lower side of the vanes 95 may be elevated relative to other vanes 95 (e.g., in the form of 'stepped' vanes 95) or, as best shown in FIGS. 10A-10F, the lower side of each of the vanes 95 may be in the same plane as the other vanes 95. In addition, the ability to adjustably orient the vanes 95 based on the case configuration provides more accurate distribution of the conditioned airflow through the merchandiser 10 so that the airflow can be tailored to the case design, which provides a more effective solution to adequately conditioning all product supported by the case 15. In addition, the discharge grill assembly 80 increases the flexibility of the merchandiser 10 relative to existing merchandisers 10 by having a merchandiser that can include different case configurations (different shelf configurations, different product configurations, or both).

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. For example, although the invention is described and illustrated herein with reference to a deli-style merchandiser, other types of merchandisers or display cases can utilize aspects of the invention described, illustrated, and recited herein. Also, any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present disclosure, and are not intended to limit the structure of the exemplary embodiments of the present disclosure to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

The invention claimed is:

1. A merchandiser comprising:

a case defining a shelf configuration having a deck plate and one or more shelves, the case including a base and a rear wall cooperating to at least partially define a product display area;

an air passageway extending through the base and at least partially along the rear wall;

a fan in communication with the air passageway and configured to generate an airflow through the air passageway;

a discharge grill positioned in the air passageway adjacent to the rear wall and below all of the one or more shelves, the discharge grill including one or more vanes having a discharge angle to direct the airflow upward from the base through a portion of the air passageway and outward from the air passageway along the shelf configuration; and a vane control coupled to the one or more vanes and including a mechanism configured to adjust the discharge angle of the one or more vanes to control the airflow through the merchandiser along the shelf configuration and based at least in part on the shelf configuration.

2. The merchandiser of claim 1, wherein the discharge angle is a first discharge angle and the one or more vanes includes a first vane having the first discharge angle and a second vane spaced from the first vane and having a second discharge angle, and wherein the mechanism is coupled to each of the first vane and the second vane to simultaneously adjust the first discharge angle and the second discharge angle.

3. The merchandiser of claim 2, wherein the first discharge angle is the same as the second discharge angle.

4. The merchandiser of claim 1, wherein the mechanism is configured to vary the discharge angle between approximately 90 degrees and approximately 40 degrees relative to a horizontal plane.

5. The merchandiser of claim 1, wherein the shelf configuration includes a single shelf.

6. The merchandiser of claim 1, wherein the discharge grill and the vane control define a discharge grill assembly, and wherein the discharge grill has a grill body supporting the one or more vanes and the vane control.

7. The merchandiser of claim 1, wherein the shelf configuration includes two shelves.

8. The merchandiser of claim 1, wherein the mechanism includes a vane block and an actuator supporting the vane block, and wherein the vane control further includes an axle supporting the mechanism.

9. The merchandiser of claim 1, wherein the mechanism includes a vane block operatively coupled to the one or more vanes and translationally movable to adjust the discharge angle of the one or more vanes.

10. A merchandiser comprising:

a case having a first case configuration including a deck plate and one or more shelves, the case including a base and a rear wall cooperating to at least partially define a product display area;

an air passageway extending through the case;

a fan in communication with the air passageway and configured to generate an airflow through the air passageway;

a discharge grill positioned in the air passageway adjacent to the rear wall and below all of the one or more shelves, the discharge grill including two or more vanes arranged at one or more discharge angles to direct the airflow through a portion of the air passageway, the two or more vanes arranged horizontally adjacent to each other in the air passageway; and a vane control coupled to the two or more vanes and including a mechanism engaged with the two or more vanes and translatable horizontally to adjust the two or more vanes to change the one or more discharge angles to control the airflow through the merchandiser.

11. The merchandiser of claim 10, wherein the first case configuration is defined by a quantity of the one or more shelves in the case.

12. The merchandiser of claim 10, wherein the first case configuration is defined by a quantity of the one or more shelves in the case and a location of the one or more shelves relative to the discharge grill.

13. The merchandiser of claim 12, wherein the first case configuration is further defined by a configuration of product in the product display area.

14. The merchandiser of claim 10, wherein the case is modifiable from the first case configuration to a second configuration different from the first configuration, wherein the two or more vanes are adjusted by the vane control to vary the one or more discharge angles based on the second case configuration.

15. The merchandiser of claim 14, wherein each of the first case configuration and the second case configuration is defined by a quantity of the one or more shelves in the case.

16. The merchandiser of claim 14, wherein each of the first case configuration and the second case configuration is defined by a quantity of the one or more shelves in the case and a location of the one or more shelves relative to the discharge grill.

17. The merchandiser of claim 10, wherein the mechanism includes an actuator and a vane block operatively coupled to the two or more vanes and movable along the actuator to adjust the one or more discharge angles of the two or more vanes.

18. The merchandiser of claim 17, wherein the mechanism is coupled to a lower end of the two or more vanes and is movable by a gear actuator.

19. The merchandiser of claim 10, wherein the two or more vanes includes a first vane having a first discharge angle and a second vane spaced from the first vane and having a second discharge angle, and wherein the mechanism is coupled to each of the first vane and the second vane to simultaneously adjust the first discharge angle and the second discharge angle.

20. The merchandiser of claim 19, wherein the first discharge angle is the same as the second discharge angle.

* * * * *